US009004957B2

(12) United States Patent
Aizawa et al.

(10) Patent No.: US 9,004,957 B2
(45) Date of Patent: Apr. 14, 2015

(54) WIRE CONNECTING STRUCTURE AND CABLE CONNECTOR ASSEMBLY

(75) Inventors: Masayuki Aizawa, Tokyo (JP); Kenji Takahashi, Kanagawa (JP); Keita Mashino, Tokyo (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 65 days.

(21) Appl. No.: 13/602,657

(22) Filed: Sep. 4, 2012

(65) Prior Publication Data

US 2012/0325554 A1 Dec. 27, 2012

Related U.S. Application Data

(63) Continuation of application No. PCT/JP2011/001095, filed on Feb. 25, 2011.

(30) Foreign Application Priority Data

Mar. 4, 2010 (JP) ..... 2010-048145

(51) Int. Cl.
*H01R 4/02* (2006.01)
*H01R 12/59* (2011.01)
*H01R 13/6473* (2011.01)

(52) U.S. Cl.
CPC ..... *H01R 12/596* (2013.01); *H01R 12/598* (2013.01); *H01R 13/6473* (2013.01)

(58) Field of Classification Search
USPC ..... 439/876, 874, 875, 63, 76.1, 629, 404, 439/941, 700, 910, 59, 604, 605, 606
See application file for complete search history.

(56) References Cited

U.S. PATENT DOCUMENTS

| | | | | |
|---|---|---|---|---|
| 5,402,088 | A * | 3/1995 | Pierro et al. | 333/33 |
| 5,532,659 | A * | 7/1996 | Dodart | 333/260 |
| 6,517,381 | B2 * | 2/2003 | Kondo | 439/604 |
| 6,984,150 | B2 * | 1/2006 | Kondou et al. | 439/606 |
| 7,731,531 | B2 * | 6/2010 | Tsujino | 439/606 |
| 7,980,893 | B2 * | 7/2011 | Sato et al. | 439/578 |
| 2001/0003687 | A1 * | 6/2001 | Kondo | 439/604 |
| 2001/0003688 | A1 * | 6/2001 | Kondo | 439/604 |
| 2009/0053943 | A1 * | 2/2009 | Fink et al. | 439/876 |

FOREIGN PATENT DOCUMENTS

| | | |
|---|---|---|
| JP | 2005085469 A | 3/2005 |
| JP | 2009134997 A | 6/2009 |

OTHER PUBLICATIONS

Notification of Transmittal of Translation of the International Preliminary Report on Patentability, dated Oct. 11, 2012, 1 page.
International Preliminary Report on Patentability, dated Oct. 2, 2012, 5 pages.
PCT Written Opinion, dated Mar. 22, 2011, 4 pages.

* cited by examiner

*Primary Examiner* — Renee Luebke
*Assistant Examiner* — Harshad Patel
(74) *Attorney, Agent, or Firm* — Barley Snyder

(57) ABSTRACT

A wire connecting structure and a cable connector assembly is provided. The wire connecting structure includes an electrical conductor, a cable and a resin. The electrical conductor includes a wire connecting portion. The cable includes an insulator and a core wire surrounded by and exposed from the insulator, the core wire connected to the wire connecting portion. The resin seals a part of the core wire exposed from the insulator and a part of the wire connecting portion.

17 Claims, 3 Drawing Sheets

WIRE CONNECTING STRUCTURE AND CABLE CONNECTOR ASSEMBLY

CROSS-REFERENCE TO RELATED APPLICATION

This application is a continuation of PCT Application No. PCT/JP2011/001095 filed on Feb. 25, 2011, which claims priority under 35 U.S.C. §119 to JP Patent Application No. 2010-048145 filed on Mar. 4, 2010.

FIELD OF THE INVENTION

The invention relates to a connector and, in particular, to a wire connecting structure and a cable connector assembly having an excellent high-speed transmission property.

BACKGROUND

With the advancements in information processing equipment and communication equipment and the increase in data volume of moving images, there is a demand for increasing the speed of signals used in each equipment. For example, a high-speed transmission property of 6 Gbps or higher is needed for connecting servers. To achieve the high-speed transmission property for connecting servers, a cable connector with an excellent high-speed transmission property and a cable with an excellent high-speed transmission property are connected and the connected cable connector is connected to a server.

Meanwhile, JP 2005-85469 A discloses a cable connector in which wires are soldered to a printed circuit board that is connected to contacts of a connector. In this cable connector, the wires and solder connecting portions of the printed circuit board are inner-molded with resin. Accordingly, the solder connecting portions are protected, and thus mechanical strength thereof is ensured with certainty.

However, the cable connector disclosed in JP 2005-85469 A has the following problem.

That is, while the mechanical strength of the solder connecting portions of the wires is ensured, impedance matching in the solder connecting portions is not taken into consideration at all. Therefore, there is a problem that the impedance of the solder connecting portions decreases remarkably due to the resin sealed along the periphery of the solder connecting portions.

SUMMARY

Accordingly, the invention has been made to solve the above problem, and has an object, among other objects, to provide a wire connecting structure and a cable connector assembly.

The wire connecting structure includes an electrical conductor, a cable and a resin. The electrical conductor includes a wire connecting portion. The cable includes an insulator and a core wire surrounded by and exposed from the insulator, the core wire connected to the wire connecting portion. The resin seals a part of the core wire exposed from the insulator and a part of the wire connecting portion.

BRIEF DESCRIPTION OF THE DRAWINGS

The features and advantages of the invention should become apparent from the following description when taken in conjunction with the accompanying drawings, in which:

FIG. 5A FIG. 5B illustrate a relationship between positions in the cable connector assembly shown in FIG. 1 in the wire connecting direction (vertical direction in FIG. 1) when resin is not provided, and impedance of an electrical conductor at those respective positions, in which FIG. 5A is a partial plan view of the cable connector assembly according to the invention; and FIG. 5B is a graph representing a relationship between the positions in the wire connecting direction of the cable connector assembly shown in FIG. 5A when resin is not provided, and the impedance of the electrical conductor corresponding to the positions.

DETAILED DESCRIPTION OF THE EMBODIMENT(S)

Embodiments of the invention will now be described with reference to FIG. 1 through FIG. 5.

Figure 1:
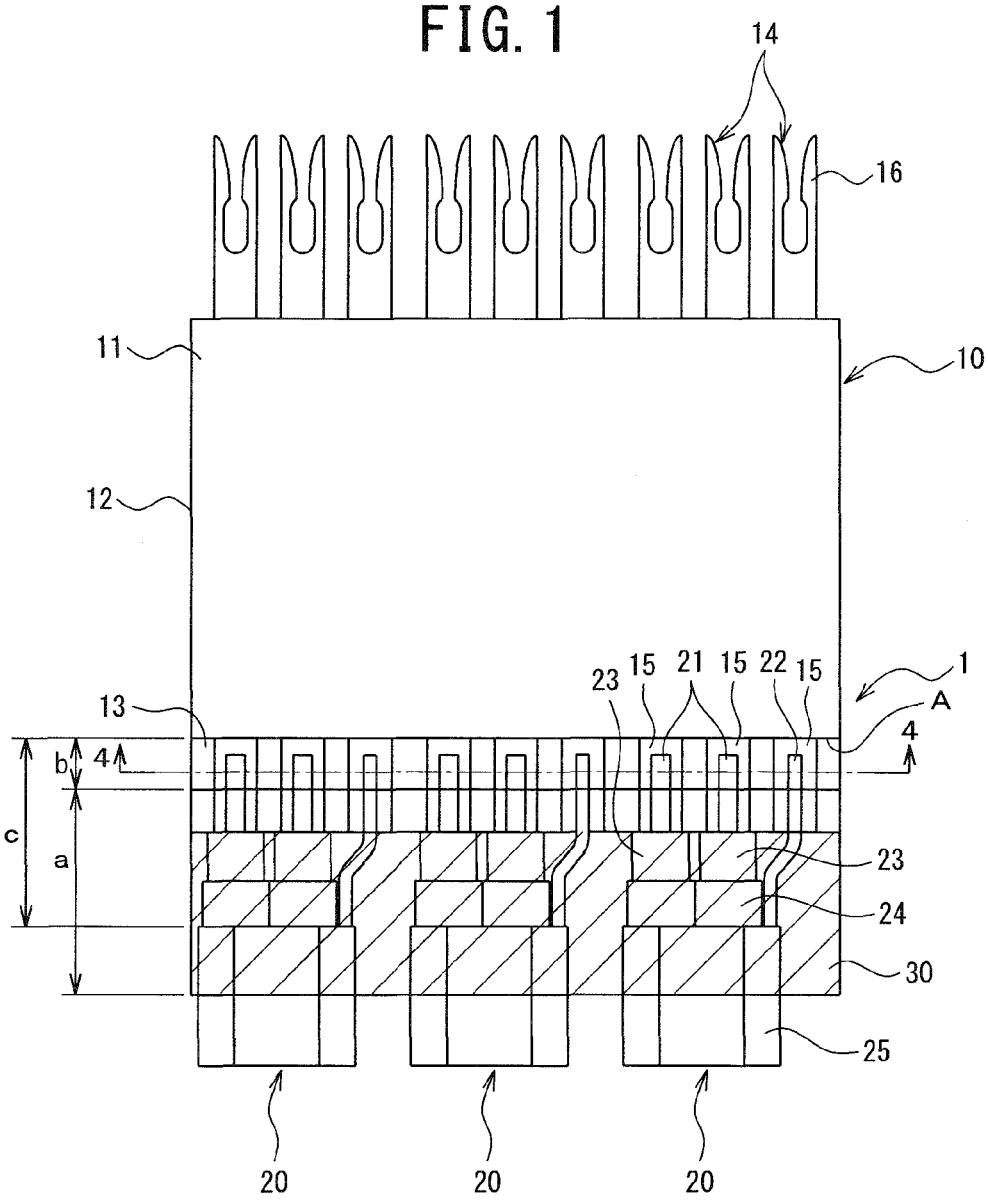
FIG. 1 is a plan view of a cable connector assembly according to the invention.
Figure 2:
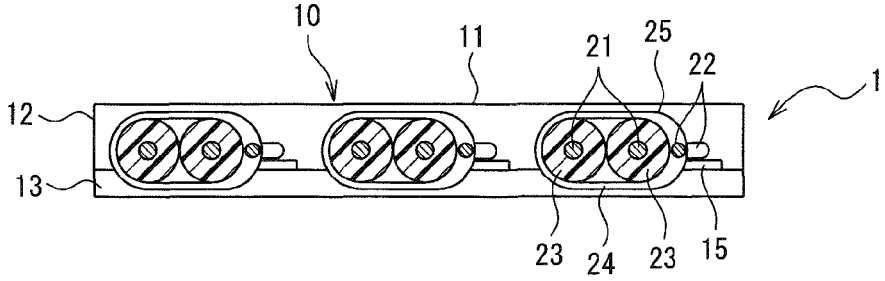
FIG. 2 is a front cross-sectional view of the cable connector assembly shown in FIG. 1, from which a resin is removed from the cable connector assembly in FIG. 2.
Figure 3:
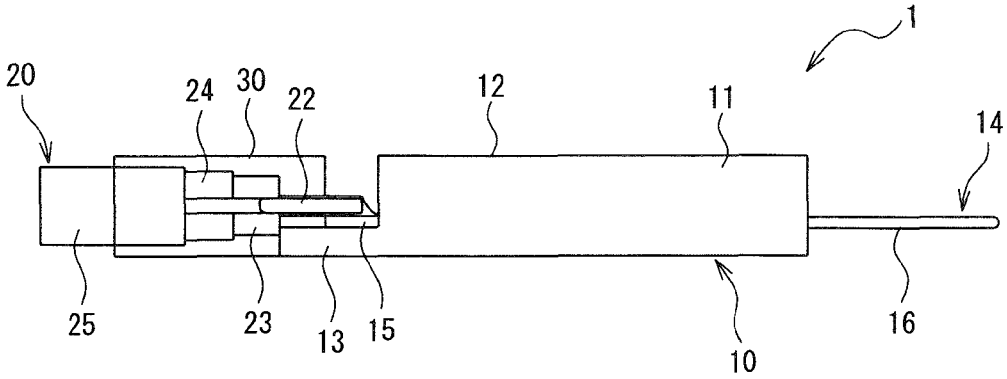
FIG. 3 is a side view of the cable connector assembly shown in FIG. 1.

A cable connector assembly 1 as shown in FIG. 1, for instance, may be used for connection between servers. More specifically, it may be used for high-speed transmission at 6 Gbps or higher. However, the cable connector assembly 1 is also applicable to other high-speed transmission, in addition to the connection between servers.

That is, the cable connector assembly 1 includes a cable connector 10 connected to a server (not shown) side, and multiple cables 20 connected to the cable connector 10, as shown in FIG. 1.

The cable connector 10 includes multiple contacts 14 and a housing 11 for housing the multiple contacts 14, as shown in FIG. 1.

In the embodiment shown, the housing 11 is made by molding an insulating resin, and includes a housing main body 12 having a substantially rectangular shape, and a platform 13 protruding from the housing main body 12. The platform 13 is thinner than the housing main body 12 and protrudes forward from the front end of the substantially rectangular housing main body 12, as shown in FIG. 1 to FIG. 4. The platform 13 has a rectangular shape, when viewed from above, as shown in FIG. 1.

Each contact 14, as shown in FIG. 1 to FIG. 4, includes a secured portion (not shown) secured to the housing main body 12, a wire connecting portion 15 extending frontward from the secured portion, and a mating contact contacting portion 16 extending backward from the secured portion. Each contact 14 is made by stamping a metal plate, or stamping and forming a metal plate. The respective contacts 14 are arranged at a predetermined pitch in the width direction (horizontal direction in FIG. 1) of the housing 11.

Figure 4:
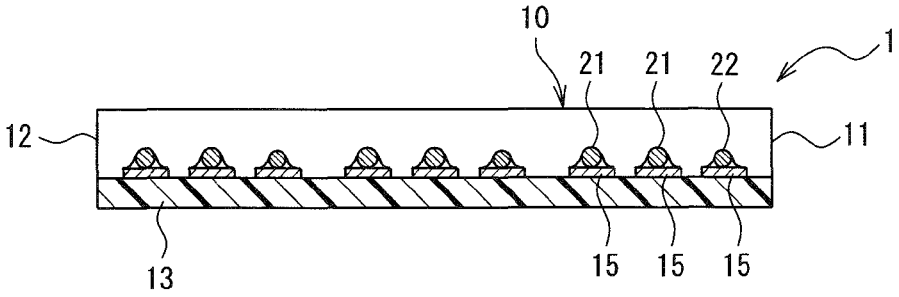
FIG. 4 is a cross-sectional view of the cable connector assembly taken along line 4-4 in FIG. 1.

The wire connecting portion 15 of each contact 14 is exposed forward from a front end portion A (see FIG. 5A), and is mounted on the platform 13, as shown in FIG. 4. The wire connecting portion 15 has a rectangular flat plate structure, when viewed from above, as shown in FIG. 1. Since the respective contacts 14 are arranged at a predetermined pitch in the width direction of the housing 11, the respective wire connecting portions 15 are also arranged at a predetermined pitch in the width direction on the platform 13. The mating contact contacting portion 16 protrudes from a back end portion of the housing main body 12 for contact with a contact of a mating connector provided on the server side.

Meanwhile, the respective cables 20, in the embodiment shown, may be Twinax cables, which are appropriate for high-speed transmission. However, other types of cables may be used without departing from the spirit of the invention. Each cable 20 includes two inner conductors (corresponding to core wires according to the invention) 21, two insulators 23 surrounding the two inner conductors 21, respectively, an outer conductors 24 arranged on the outer periphery of the insulators 23, and an outer jacket 25 provided on the outer periphery of the outer conductors 24. The outer conductor 24 is a metallic annular member called MYLAR (registered trademark). The outer jacket 25 covers the outer conductor 24. Moreover, a drain wire 22 in electrically contact with the outer conductor 24 is provided between the outer conductor 24 and the outer jacket 25.

The inner conductors 21 of the respective cables 20, as shown in FIG. 1, are exposed from the insulator 23, the insulator 23 is exposed from the outer conductor 24, and the outer conductor 24 is exposed from the outer jacket 25. The drain wire 22 is also exposed from the outer jacket 25. The two inner conductors 21 and the drain wire 22 of each cable 20 are connected by solder connection onto the wire connecting portion 15 exposed to the outside from the housing main body 12 of the contact 14. Each inner conductor 21 and each drain wire 22 are connected such that front end positions thereof are arranged at positions spaced apart from the front end portion A of the housing main body 12 by a predetermined gap.

Furthermore, the resin 30, such as a thermoplastic resin, continuously seals from the outer jacket 25 to the wire connecting portion 15, to cover a part of the outer jacket 25, the exposed outer conductor 24, the exposed insulator 23, a part of the exposed inner conductors 21, a part of the exposed drain wire 22, and a part of the exposed wire connecting portion 15. The resin 30 seals all of the cables 20 in the width direction of the cable connector 10. The resin 30 that seals is a rectangular shape in the embodiment shown.

As shown in FIG. 1, "a" is a length from an end portion on the cable 20 side of the resin 30 to an end portion on the wire connecting portion 15 side. The resin 30 seals to form a gap "b" between the resin 30 and the housing main body 12. "c" is a length from the outer jacket 25 to the housing main body 12.

In this manner, the resin 30 seals a part of the outer jacket 25, the exposed outer conductor 24, the exposed insulator 23, a part of the exposed inner conductors 21, a part of the exposed drain wire 22, and a part of the exposed wire connecting portion 15. This ensures the necessary mechanical strength from the outer jacket 25 to the wire connecting portion 15, including the connecting portion of the inner conductor 21 and the wire connecting portion 15, and the connecting portion of the drain wire 22 and the wire connecting portion 15. By sealing with the resin 30, in the sealing portion, the gap in the periphery of the connecting portion of the inner conductor 21 and the wire connecting portion 15 and the gap in periphery of the connecting portion of the drain wire 22 and the wire connecting portion 15 are eliminated. This improves a retaining strength of the connecting portion of the inner conductor 21 and the wire connecting portion 15, and a retaining strength of the connecting portion of the drain wire 22 and the wire connecting portion 15. Although free ends of the inner conductors 21 and the drain wire 22 are exposed, opposite sides to the free ends are sealed with the resin 30. Therefore, since the retaining strength of the connecting portion of the inner conductor 21 (and the drain wire 22) and the wire connecting portion 15 is ensured, it is possible to resist against an external force applied on the cables 20. Moreover, it is possible to protect the connecting portion of the inner conductor 21 and the wire connecting portion 15, and the connecting portion of the drain wire 22 and the wire connecting portion 15. Furthermore, it is possible to ensure the alignment property of adjacent inner conductors 21 and the drain wire 22, and the alignment property of adjacent cables 20.

Relationship between positions in a wire connecting direction (vertical direction in FIG. 1) of the cable connector assembly 1 and impedance of the electrical conductor at those positions, in a state (when resin is not provided) where the inner conductors 21 and the drain wire 22 are connected to the wire connecting portion 15, will be described with reference to FIG. 5A and FIG. 5B.

Figure 5A:
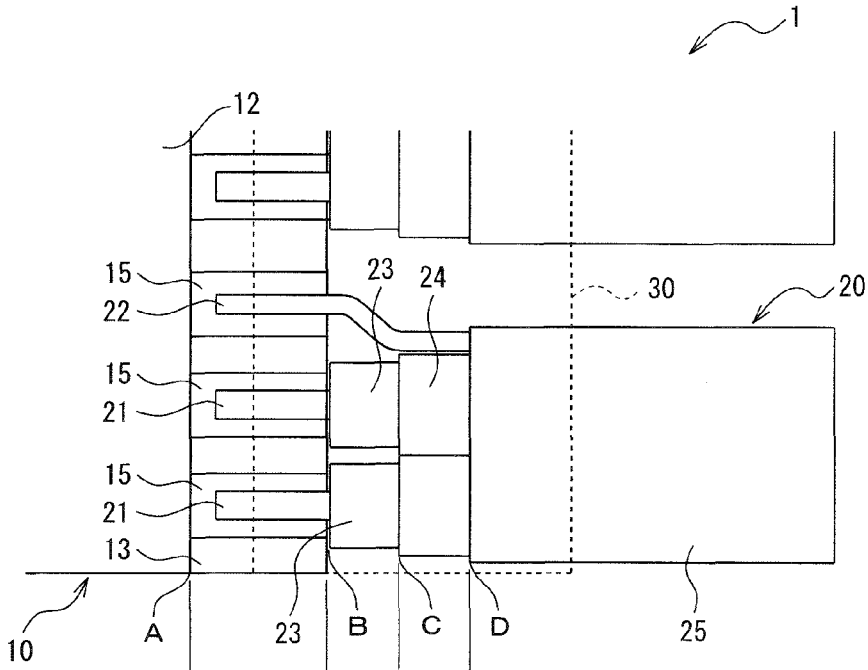
Figure 5B:
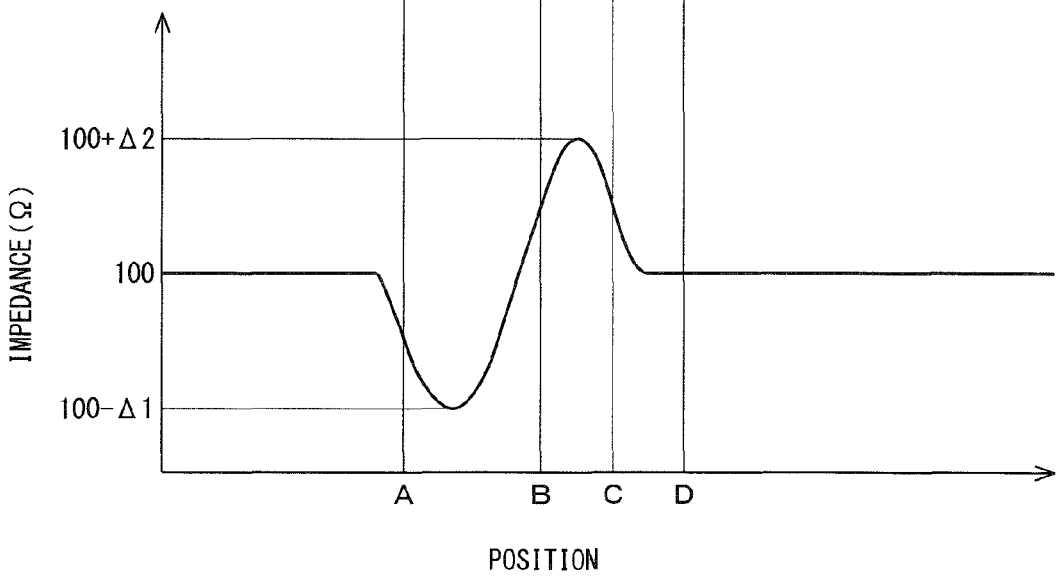

In FIG. 5A, the impedance from the back end side of the contact 14 of the cable connector 10 to the front end portion A of the housing main body 12 is stable at approximately 100Ω, as shown in FIG. 5B.

The area from the front end portion A of the housing main body 12 to the exposed wire connecting portion 15 is connected by solder connecting the inner conductor 21 and the drain wire 22, as shown in FIG. 4. The impedance of the wire connecting portion 15 (including the connecting portion of the inner conductors 21 and the drain wire 22) from the front end portion A of the housing main body 12 to a front end portion B of the platform 13 decreases to reach 100−Δ1Ω once, and then increases to 100Ω or greater, as shown in FIG. 5B.

In general, in coaxial cables or parallel lines used for high-speed transmission, where characteristic impedance "$Z_0$" of a uniform transmission path without a loss of an electrical conductor having inductance per unit length of "L" and an insulator having capacitance per unit length of "C" is represented by the following Expression 1.

Expression 1

$$Z_0 = \sqrt{\frac{L}{C}} \tag{1}$$

Moreover, in an object in which "S" is an opposing area in each of two parallel electrical conductors and "d" is a distance there between, and a dielectric substance having a dielectric constant ∈ is filled there between, the capacitance "C" is generally represented by the following Expression 2

$$C = \in \cdot S/d \tag{2}$$

The inner conductor 21 and the drain wire 22 are connected to the wire connecting portion 15 exposed from the front end portion A of the housing main body 12 by solder connecting. Since the volume of the connecting portion increases through soldering, the opposing area of adjacent connecting portions of the inner conductors 21 and the wire connecting portions 15 is considered to increase more than an opposing area of adjacent contacts 14 in the housing main body 12. In addition, the opposing area of adjacent connecting portions of the drain wires 22 and the wire connecting portions 15 is also considered to increase more than the opposing area of the adjacent contacts 14 in the housing main body 12. Therefore, when the contact 14 extends from the inside of the housing main body 12 to the wire connecting portion 15, "S" in Expression 2 increases, and the capacitance "C" also increases, accordingly. Such an increase in the capacitance "C" decreases the characteristic impedance "$Z_0$" in Expression 1 to reach 100−Δ1Ω, for instance. Moreover, when the peak is set to a position where the characteristic impedance "$Z_0$" of 100−1Ω and the position is exceeded, the characteristic impedance "$Z_0$" will increase as the opposing area of the adjacent connecting portions decreases.

The impedance from the front end portion B of the platform 13 to an end portion C of the outer conductor 24, namely the impedance of each of the inner conductors 21 within the exposed portion of the insulator 23 increases to reach 100+Δ2Ω once, as shown in FIG. 5B. Then, when the peak is set to a position where the characteristic impedance "$Z_0$" of 100+Δ2Ω is exceeded, the characteristic impedance "$Z_0$" will decrease to reach around 100Ω. The capacitance "C" in Expression 2 becomes smaller, since the opposing area of the inner conductor 21 within the exposed portion of the insulator 23 and the drain wire 22 is small and the distance between the inner conductor 21 and the drain wire 22 is long. This increases the characteristic impedance "$Z_0$" in Expression 1 to reach 100+Δ2Ω. As the outer conductor 24 approaches, the characteristic impedance "$Z_0$" decreases.

The impedance from the end portion C of the outer conductor 24 to an end portion D of the outer jacket 25, namely the impedance of the inner conductor 21 within the exposed outer conductor 24 gradually decreases and become stable at around 100Ω, as shown in FIG. 5B. Since the outer conductor 24 surrounds the insulator 23, the distance from the inner conductors 21 is constant, and the opposing area opposite to the inner conductor 21 is large, the capacitance "C" in Expression 2 increases and becomes stable. This decreases the characteristic impedance "$Z_0$" in Expression 1 to reach approximately 100Ω, becoming stable accordingly.

The impedance of the inner conductor 21 in the cable 20 from the end portion D of the outer jacket 25 is stable at approximately 100Ω, as shown in FIG. 5B.

At this time, as described above, the resin 30 covers a part of the outer jacket 25, the exposed outer conductor 24, the exposed insulator 23, a part of the exposed inner conductor 21, a part of the exposed drain wire 22, and a part of the exposed wire connecting portion 15.

Then, the impedance of the wire connecting portion 15 from the front end portion A of the housing main body 12 to the front end portion B of the platform 13 (including the connecting portion of the inner conductor 21 and the drain wire 22) decreases. This is because the resin 30 seals, the dielectric constant "∈" in Expression 2 increases, thereby increasing the capacitance "C".

The decrease in the impedance of the inner conductor 21 from the front end portion B of the platform 13 to the end portion C of the outer conductor 24 is favorable in light of impedance matching, because the impedance of the inner conductor 21 in the cable 20 from end portion D of the outer jacket 25 approaches around 100Ω.

However, when the impedance of the wire connecting portion 15 from the front end portion A of the housing main body 12 to the front end portion B of the platform 13 decreases, the impedance from the back end side of the contact 14 of the cable connector 10 to the front end portion A of the housing main body 12 becomes apart from approximately 100Ω. This is not favorable in light of the impedance matching.

Suppose that the resin 30 seals the entirety of the exposed inner conductor 21, the entirety of the exposed drain wire 22, and the entirety of the exposed wire connecting portion 15. Then, the dielectric constant "∈" in Expression 2 further increases, the capacitance "C" further increases, and the impedance of the wire connecting portion 15 from the front end portion A of the housing main body 12 to the front end portion B of the platform 13 (including the connecting portion of the inner conductor 21 and the drain wire 22) decreases.

Accordingly, in the shown embodiment, the resin 30 seals a part of the exposed inner conductor 21, a part of the exposed drain wire 22, and a part of the exposed wire connecting portion 15 so as to prevent an excessive decrease in the impedance. This allows the impedance matching to provide a cable connector assembly 1 having an excellent high-speed transmission property.

Note that it is possible to adjust the size of the gap b (see FIG. 1) formed between the resin 30 and the housing main body 12 by changing the quantity of the resin 30 to seal, so as to adjust the impedance of the wire connecting portion 15 (including the connecting portion of the inner conductor 21 and the drain wire 22). If the gap b is larger, the decrease in impedance of the wire connecting portion 15 can be smaller, whereas if the gap b is smaller, the decrease in impedance of the wire connecting portion 15 can be larger.

Therefore, it is possible to adjust the size of the gap b for the impedance matching of the wire connecting portion 15.

Moreover, since the resin 30 continuously seals from the outer jacket 25 to the wire connecting portion 15, the mechanical strength in this area can be enhanced. In addition, it is possible to decrease such an excessively high impedance in the area from the end portion B to the end portion C where the insulator 23 is exposed, in particular.

Heretofore, an exemplary embodiment of the invention has been described. However, the invention is not limited to this, and various modifications and adaptations to the embodiment may be carried out.

For example, an object connected to the cable 20 is not limited to the contact 14 of the cable connector 10. A typical electrical conductor such as a conductor pattern formed on a printed circuit board may be connected to the cable 20. In this case, the housing 11 may not be necessarily provided, and the inner conductor 21 of the cable 20 and the drain wire 22 are connected to the exposed wire connecting portion of the electrical conductor. Furthermore, the resin 30 continuously seals from the outer jacket 25 to the wire connecting portion to cover a part of the outer jacket 25, the exposed outer conductor 24, the exposed insulator 23, a part of the exposed inner conductor 21, and a part of the exposed wire connecting portion. In the case of connecting the electrical conductor to the cables 20, the inner conductor 21 of the cable 20 is exposed from all of the insulator 23, the outer conductor 24, and the outer jacket 25. This case may be a case where the insulator 23 is exposed from the outer conductor 24 and the outer conductor 24 is not exposed from the outer jacket 25. In this case, the resin 30 continuously seals from the outer jacket 25 to the wire connecting portion to cover a part of the outer jacket 25, a part of the exposed inner conductor 21, and a part of the exposed wire connecting portion.

Furthermore, in the cable connector assembly 1, the inner conductor 21 of the cable 20 should be exposed from all of the insulator 23, the outer conductor 24, and the outer jacket 25. The insulator 23 may be exposed from the outer conductor 24, but the outer conductor 24 may not be exposed from the outer jacket 25. In this case, the resin 30 continuously seals from the outer jacket 25 to the wire connecting portion to cover a part of the outer jacket 25, a part of the exposed inner conductor 21, and a part of the exposed wire connecting portion.

Moreover, the cables applicable to the invention are not limited to Twinax cables, and cables suitable for high-speed transmission are applicable, such as coaxial cables, shielded twist pair (STP) cables, shielded parallel pair (SPP) cables, twin coaxial cables, or twisted pair cables without an outer conductor, quad cables, etc.

Furthermore, in the cable 20, the drain wire 22 may not be necessarily provided.

Moreover, the resin is not limited to thermoplastic resin, and may be another resin, such as ultraviolet (UV) cure adhesive or the like.

Yet furthermore, the cable connector is not limited to a cable connector including metal contacts and a housing for housing these contacts therein, and may have a built-in printed circuit board including a pattern thereon constituting the contacts. In this case, the housing may be made of metal. Alternatively, a cable connector may include metal contacts and an intermediary board connected to these contacts and a wire connecting portion is formed on the intermediary board as a circuit pattern.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A wire connecting structure comprising:

an electrical conductor having a wire connecting portion;

a cable having an insulator and a core wire surrounded by and exposed from the insulator, the core wire connected to the wire connecting portion; and a resin sealing a part of the core wire, a part of the insulator, and a part of the wire connecting portion such that an end of the core wire that connects to the wire connecting portion extends out of the resin.

2. The wire connecting structure according to claim 1, wherein the resin covers the cable from the insulator to the wire connecting portion.

3. The wire connecting structure according to claim 2, wherein the resin covers the insulator of the cable, the exposed core wire, and the part of the wire connecting portion.

4. The wire connecting structure according to claim 3, wherein the cable is one of a Twinax cable, a coaxial cable, a shielded twist pair cable, a shielded parallel pair cable, a twin coaxial cable, a twisted pair cable, and a quad cable.

5. The wire connecting structure according to claim 3, wherein the resin is either a thermoplastic resin or an ultraviolet cure adhesive.

6. A cable connector assembly comprising:

a cable connector having a plurality of contacts, a housing accommodating the plurality of contacts therein, and a wire connecting portion exposed from the housing;

a cable having an insulator and a core wire surrounded by and exposed from the insulator, the core wire connected to the wire connecting portion; and a resin sealing a part of the core wire, a part of the insulator, and a part of the wire connecting portion such that an end of the core wire that connects to the wire connecting portion extends out of the resin.

7. The cable connector assembly according to claim 6, wherein the resin covers the cable from the insulator to the wire connecting portion.

8. The cable connector assembly according to claim 7, wherein the resin covers the insulator of the cable, the exposed core wire, and the part of the wire connecting portion.

9. The cable connector assembly according to claim 8, wherein the cable connector includes a printed circuit board.

10. The cable connector assembly according to claim 9, wherein the contacts are circuit patterns on the printed circuit board.

11. The cable connector assembly according to claim 9, wherein the contacts are metal contacts and a circuit pattern on the printed circuit board.

12. The cable connector assembly according to claim 6, wherein the cable is one of a Twinax cable, a coaxial cable, a shielded twist pair cable, a shielded parallel pair cable, a twin coaxial cable, a twisted pair cable, and a quad cable.

13. The cable connector assembly according to claim 6, wherein the resin is either a thermoplastic resin or an ultraviolet cure adhesive.

14. A wire connecting structure comprising:

a cable connector having a main body with a platform, a wire connecting portion positioned on the platform, a contact positioned opposite the wire connecting portion;

a cable having an insulator and a core wire surrounded by and exposed from the insulator, the core wire connected to the wire connecting portion; and a resin sealing a part of the core wire exposed from the insulator and a part of the wire connecting portion, such that an end of the core wire that connects to the wire connection portion extends out of the resin.

15. The cable connector assembly according to claim 14, wherein the resin covers the cable from the insulator to the wire connecting portion.

16. The wire connecting structure according to claim 14, wherein the cable is one of a Twinax cable, a coaxial cable, a shielded twist pair cable, a shielded parallel pair cable, a twin coaxial cable, a twisted pair cable, and a quad cable.

17. The wire connecting structure according to claim 14, wherein the resin is either a thermoplastic resin or an ultraviolet cure adhesive.

* * * * *